US006521000B1

(12) United States Patent
McFarland et al.

(10) Patent No.: US 6,521,000 B1
(45) Date of Patent: Feb. 18, 2003

(54) PROCESS FOR FORMING SCRUBBED STRETCH DENIM FABRIC

(75) Inventors: James E. McFarland, Mooresville, NC (US); George R. Burkert, Meridian, MI (US); Robert C. Smith, Stonewall, MI (US)

(73) Assignee: Burlington Industries, Inc., Greensboro, NC (US)

( * ) Notice: Subject to any disclaimer, the term of this patent is extended or adjusted under 35 U.S.C. 154(b) by 0 days.

(21) Appl. No.: 09/537,704

(22) Filed: Mar. 30, 2000

(51) Int. Cl.[7] ..... D06B 0/00; D06P 3/82; C09B 7/00

(52) U.S. Cl. ..... 8/918; 8/149.1; 8/494; 8/532; 8/637.1; 8/653; 8/916

(58) Field of Search ..... 8/494, 653, 149.1, 8/532, 918, 637.1, 916

(56) References Cited

U.S. PATENT DOCUMENTS 4,283,194 A 8/1981 Teague et al. ..... 8/494
4,342,565 A 8/1982 Teague et al. ..... 8/532
5,595,071 A * 1/1997 Pasad et al. ..... 65/8
5,737,813 A * 4/1998 Stermlieb et al. ..... 28/167

* cited by examiner

*Primary Examiner*—Yogendra N. Gupta
*Assistant Examiner*—D G Hamlin
(74) *Attorney, Agent, or Firm*—Nixon & Vanderhye

(57) ABSTRACT

A woven fabric formed of dyed blended cotton/polyester warp yarns and polyester stretch fill yarns is finished by passing the fabric through a brusher and singer and then through a finishing pad box to apply the finish. Immediately after application of the finish to the yarns, the fabric is passed over pre-drying cans and set by attaching the fabric to an unheated tenter chain for width control. The fabric is then passed over steam drying cans to reduce the moisture level to 8–10%. Subsequently, the fabric is passed through a first compressive shrinking machine, a scrubbing operation and then through a final compressive shrinking machine.

17 Claims, 2 Drawing Sheets

PROCESS FOR FORMING SCRUBBED STRETCH DENIM FABRIC

TECHNICAL FIELD

The present invention relates to a process for forming scrubbed stretch denim fabric and particularly relates to a process for forming the fabric employing a simplified finishing technique which is less costly, amenable to higher fabric production rates and has a reduced potential for off-quality fabric.

BACKGROUND

Various types of dyeing and finishing procedures have been used in the past to form scrubbed stretch denim fabric. For example, in U.S. Pat. No. 4,342,565, of common assignee herewith, the disclosure of which is incorporated herein by reference, there is set forth a method for forming fabric of this type, i.e., a weave of cotton and polyester spun blend warp yarns and a fill yarn, preferably formed of stretch polyester, that has been preferably air-textured and entangled or produced by false twisting and heat setting or other known texturing techniques. As set forth in that patent, the scrubbed stretch denim fabric typically includes 388 warp ends woven with the stretch fill yarns in a 2/1 RH twill pattern producing a greige construction width of about 66½ inches with about 59 ends and 35 picks per inch and a finished construction width of about 58 inches with 68 ends and 39 picks per inch.

Over the years, that process has been modified to form essentially the same scrubbed stretch denim fabric construction. The process disclosed in U.S. Pat. No. 4,342,565, modified as currently employed to produce commercial scrubbed stretch denim fabric prior to the present invention is described with reference to FIG. 1 herein. The current methods have altered the patented process of U.S. Pat. No. 4,342,565 in many respects, including eliminating hot dyeing. The currently employed method of dyeing the yarns used to form present-day commercial scrubbed stretch denim fabric commences as illustrated in FIG. 1, with an initial scouring of the yarns using a scouring bath 10 similarly as set forth in U.S. Pat. No. 4,342,565 but with a different scouring solution. The current scouring bath is an aqueous solution comprised of 55 pounds of Sedgequest EDTA-100; 168 pounds of Caustic (50%); 52 pounds of Penetrant TER; and 3 pounds of a Defoamer 2403 and sufficient water to bring the total volume to 900 gallons. The yarns are passed through the dyeing process including the a scouring bath at a rate of about 38 yards per minute (YPM) and passed through the scouring bath 10 at a preferred scouring temperature of 190° F. for 15 to 25 seconds. Following scouring, the yarns are rinsed in a series of baths 12 and 14 of hot water ranging in temperature from 160° F. down to 80° F, to remove natural oils, waxes or other additives from prior textile operations. The final rinsing is in a cold wash bath 16 at approximately 90° F.

In contrast to the patented process set forth in U.S. Pat. No. 4,342,565, the current processing provides for dyeing wet on wet yarns. This is accomplished by increasing the squeeze roll pressure on the last wash bath prior to dyeing to maximize the wet pick-up potential. Thus, instead of passing the yarns over drying cans prior to dyeing as in the patented process, the yarns are introduced directly into the indigo dye bath. The dye bath is maintained at a temperature in a range of about 70° to 90° and preferably 85° F. The currently employed indigo dye bath is preferably prepared in accordance with the following example wherein the indigo stock mix includes 171 pounds of caustic (50%), 23 pounds of dry hydrosulfite, 630 pounds of Indigo paste (20%), and 13 pounds of Penetrant TER and sufficient cold water to bring the total volume to 250 gallons. The hydro portion of the dye bath mix comprises 41 pounds of dry hydrosulfite and 44 pounds of caustic (50%) and sufficient cold water to bring the total volume of the hydro portion to 200 gallons. The hydro solution is mixed at a temperature of approximately 70° F. and is mixed with the indigo stock mix, the combination of the indigo stock mix and hydro mix being maintained at an ambient temperature in a range of 70°–90° F. and preferably approximately 85° in the dye bath.

In the current method, the warp yarns make three passes through the dye baths indicated at 18, 20 and 22 in FIG. 1, with the warp yarn remaining immersed in each bath approximately 5 to 15 seconds and being skyed after each pass as discussed below. The immersion time of approximately 5 to 15 seconds is sufficient to have the dye solution penetrate the yarn. The reduced indigo, caustic and hydro mixture is continuously fed to the indigo dye baths to maintain a substantially constant indigo concentration level and to simultaneously maintain a high oxidation reduction potential of approximately 960 mv. In contrast to the patented process, the current process is to dye the yarns at normal temperatures. ranging from 70–90° F. and preferably about 85° F.

The yarns emerging from each dye bath are passed through the atmosphere or "skyed" for approximately one minute to complete reoxidizing the indigo. The skying following each dye bath 18, 20 and 22 is indicated at 19, 21 and 23, respectively, in FIG. 1. Subsequent to the final skying at 23, the warp yarn is washed in 3–7 successive running washes ranging in temperatures from 80° F. to 140° F. as indicated at 26, 28, 30, 32, 34 and 36 in FIG. 1. The preferred temperatures for the cold washes are indicated in FIG. 1. Subsequent to the cold washing of the dyed yarns, the yarns are passed through a softener mix maintained at a temperature of approximately 125° F. The softener mix, as currently employed, comprises 190 pounds of Indilube C-20 in an aqueous mixture to obtain a total volume of approximately 400 gallons. The yarns are then dried over a series of dry cans 40, 42, 44, 46, 48, 50 and 52 as illustrated in FIG. 1. While the dyeing techniques currently used to dye yarns for forming commercial scrubbed stretch denim fabric are dissimilar in the foregoing respects from the dyeing technique disclosed in U.S. Pat. No. 4,342,565, the resulting textile product dyed by the current procedure has a similar indigo dye penetration deep into the fiber bundle without the yarns exhibiting the usual ring-dyed effect occurring in regular indigo dyeing.

Subsequent to dyeing the warp yarns, the dyed warp yarns and stretch fill yarns are woven to form the denim fabric and thereafter finished to produce the scrubbed appearance, proper hand and final finished stretch characteristics desired for the denim fabric. In the current finishing process as illustrated in FIG. 1, the woven fabric is first brushed and passed through a singer, as indicated at 54 and 56, respectively. Before passing the woven fabric through open width wash boxes as in the patented process, the current process passes the woven yarn through a preparation pad box wherein the fabric travels over a series of immersed rolls, and subsequently passed through a squeeze roll. This helps develop stretch by applying wet heat to reduce fabric width. A scouring agent is employed in the preparation pad box 58 to remove loose unfixed dye on the fabric. The preparation pad box includes a bath of 12 pounds Protowet 5917 and two pounds Defoamer 2403 in a water solution of approximately 875 gallons. Thus, the aqueous solution contains 0.17% of scouring agent.

As in the prior patented process, the woven fabric is then passed through a series of open width wash boxes schematically indicated at 60 for washing the fabric at temperatures in a range of 130–160° F. These temperatures are lower than the corresponding processing temperatures set forth in the patented process. The wash boxes are maintained with a pH of about 10 or 11 and the fabric moves at approximately 65 yards per minute through the wash boxes. Subsequent to the wash boxes, the fabric is passed over a series of drying cans 62 with steam supplied the cans in a range of 30 to 60 pounds per square inch to provide a fabric moisture content of about 6–8%. Current industry standards indicate that to develop filling stretch, hot water and heat are necessary to reduce the width of the fabric and that the fabric should be tensioned in the warp direction. These standards are applicable to the current process.

Subsequent to drying, the fabric is finished by passing the fabric through a finishing pad 64. The finishing pad 64 comprises an aqueous solution of 160 pounds ITQ Softener HD 55, 16 pounds Sedgemul DNS-2, 5 pounds pigment, N Blue 2GC, 1 pound pigment Violet 4 BC, 33 pounds Discol 2007 and 1 pound Defoamer 2403 in sufficient water to bring the volume to 475 gallons. Maintained at 100–120° F., the fabric is passed through the finish pad solution such that the solution is applied to the fabric with a 60% wet pick-up rate. Following application of the finish, the fabric passes onto a stack of drying cans 66 supplied with steam in a range of 0 to 30 psi to provide a fabric having a moisture content of about 18–20%. The fabric then enters a combined tenter frame and drying oven 68 which dries the fabric at a temperature in a range of approximately 180–220° F. to provide a fabric with a moisture content of approximately 8–10%. The speed of the fabric passing through the finishing process from the scrubbing step 54 through the tenter and drying oven 68 is about 65 yards per minute. Rather than passing the fabric over a series of compressive shrinking machines to mechanically stretch the fabric, lessening the picks per inch in the greige fabric as in the patented process, the fabric is subjected to one compressive shrinking cycle in which the fabric is passed through the compressive shrinking machine at 48–52 yards per minute, achieving an 8–10% shrunk fabric width of 60–61 inches. From the compressive shrinking machine 70, the fabric is passed through a scrubbing operation, i.e., scrubber 72, at a speed of approximately 50 ypm, with surfaces in a range of 24–220 grit. As compared with the patented process, a second scrubbing operation was found to be unnecessary. Accordingly, the fabric following the scrubbing operation is passed through a final compressive shrinking machine 74 with the shrinking occurring in the warp direction at a rate of approximately 2% to about 8% to obtain a finished width of about 58.5–59.5 inches. The foregoing described current dyeing and finishing process produces a very similar scrubbed stretch denim fabric as in the process set forth in U.S. Pat. No. 4,342,565. However, the new process affords substantial advantages over both the patented and current processes described above.

DISCLOSURE OF THE INVENTION

As in the current process, the new process in accordance with the present invention does not employ hot dyeing as in U.S. Pat. No. 4,342,565. The resulting fabric is also somewhat similar employing a polyester and carded cotton blend for the warp yarns and a stretch polyester yarn for the fill yarns. In particular, an 8.50/1 blended cotton/polyester yarn comprised of 25% polyester (2¼ denier×1½ inches staple length) and 75% carded cotton is preferred. In the new process, the fabric typically includes 4008 warp ends woven with stretch fill yarns in a 2/1 RH twill pattern, producing a greige construction width of about 67½ inches, with about 60 ends and 39 picks per inch in a finished construction width of about 60 inches with 68 ends and 39 picks per inch. The dyeing process for the new process according to the present invention is essentially the same as described above with respect to the current process. However, the finishing procedure is substantially different.

In accordance with the present invention, the dyed woven fabric is brushed and passed through a singer. Next, rather than passing the fabric through a series of open width wash boxes and maintaining the fabric under tension, the fabric is passed through a finishing pad with minimal tension and then passed through a series of pre-drying steam cans to afford a fabric moisture of 16–18%.

The new process thus eliminates the preparation pad, the open width washing and the pre-drying cycle prior to the finishing pad as in the current process. Yarn producers in the industry have consistently maintained that to develop filling stretch in fabrics, certain procedures should be followed in accordance with the yarn manufacturers' specifications. Those manufacturers have stressed the importance of developing filling stretch by application of hot water and heat. Consequently, users of the yarns have typically provided the series of wash boxes and drying cans between the scouring and finish application steps as in the current process. However, in accordance with the present invention, it has been discovered that if the fabric is wetted out with normal finishing and is passed directly onto steam drying cans, the heat of drying produces steam on the fabric which develops filling stretch. Also, the tension normally applied to the fabric during finishing has been found to be detrimental. Thus, if the fabric is heated wet with very little tension, the fabric will tend to collapse on its own and, hence, develop filling stretch. Consequently, it is possible to finish the fabric in fewer and simplified steps at less expense and at faster production speeds with a higher potential of improved quality and reduced potential for off-quality goods. Employing the new process of the present invention also reduces the amount of pilling in the final fabric.

In a preferred embodiment according to the present invention, there is provided a process for finishing a stretchable woven denim fabric having cellulose containing warp yarns dyed with an indigo dye solution and stretch fill yarns, comprising the steps of (a) applying a finish including a pigment, a fixer, a surfactant and an anti-ozonate to the woven fabric, (b) subsequent to step (a), pre-drying the fabric, (c) setting the width of the fabric by disposing the fabric on a tenter frame, (d) subsequent to step (c), drying the fabric using steam cans, (e) subsequent to step (d), passing the fabric through a compressive shrinking machine and (f) scrubbing the fabric.

BEST MODE FOR CARRYING OUT THE INVENTION

The present invention provides a new process for manufacturing scrubbed stretch denim fabric having the above-described parameters. The dyeing portion of the process for forming the fabric is set forth above in connection with the dyeing process portion of FIG. 1. The present invention is primarily applicable to a new and improved finishing process for forming the scrubbed stretch denim fabric as set forth in the schematic diagram of the finishing process of FIG. 2.

Differences in the final products formed by the new and current processes have been observed. Such differences include a smoother and more consistent brush/hand with less pilling than currently processed fabrics after multiple launderings of the fabric. Apart from those differences and the additional differences in the fabric construction noted above, the fabric is similar to the fabric disclosed in U.S. Pat. No. 4,342,565 and also the fabric manufactured using the current process described above.

Figure 1:
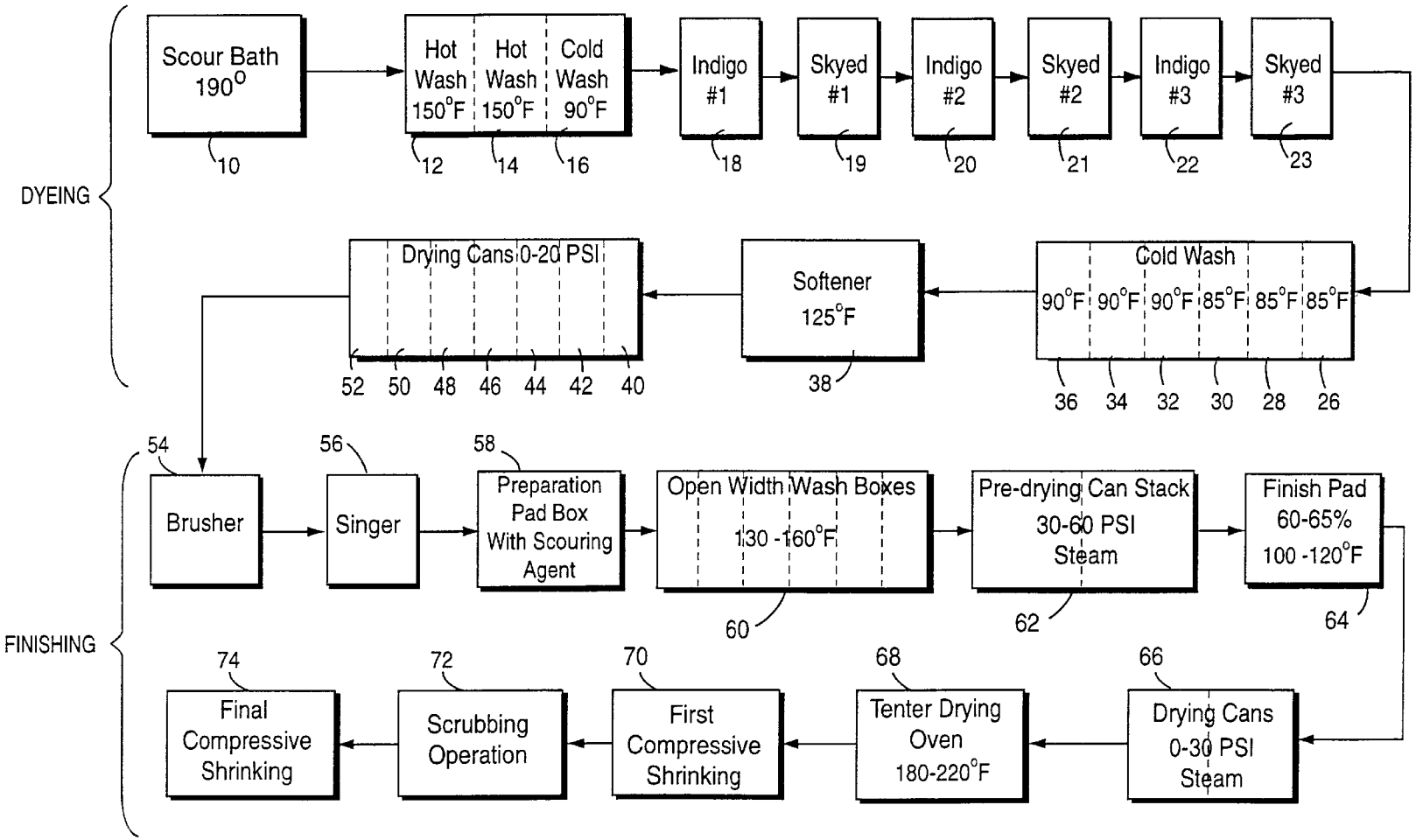
Fig. 1 (Prior Art)
FIG. 1 is a schematic illustration of a current process for forming scrubbed stretch denim fabric in accordance with the. prior art.
Figure 2:
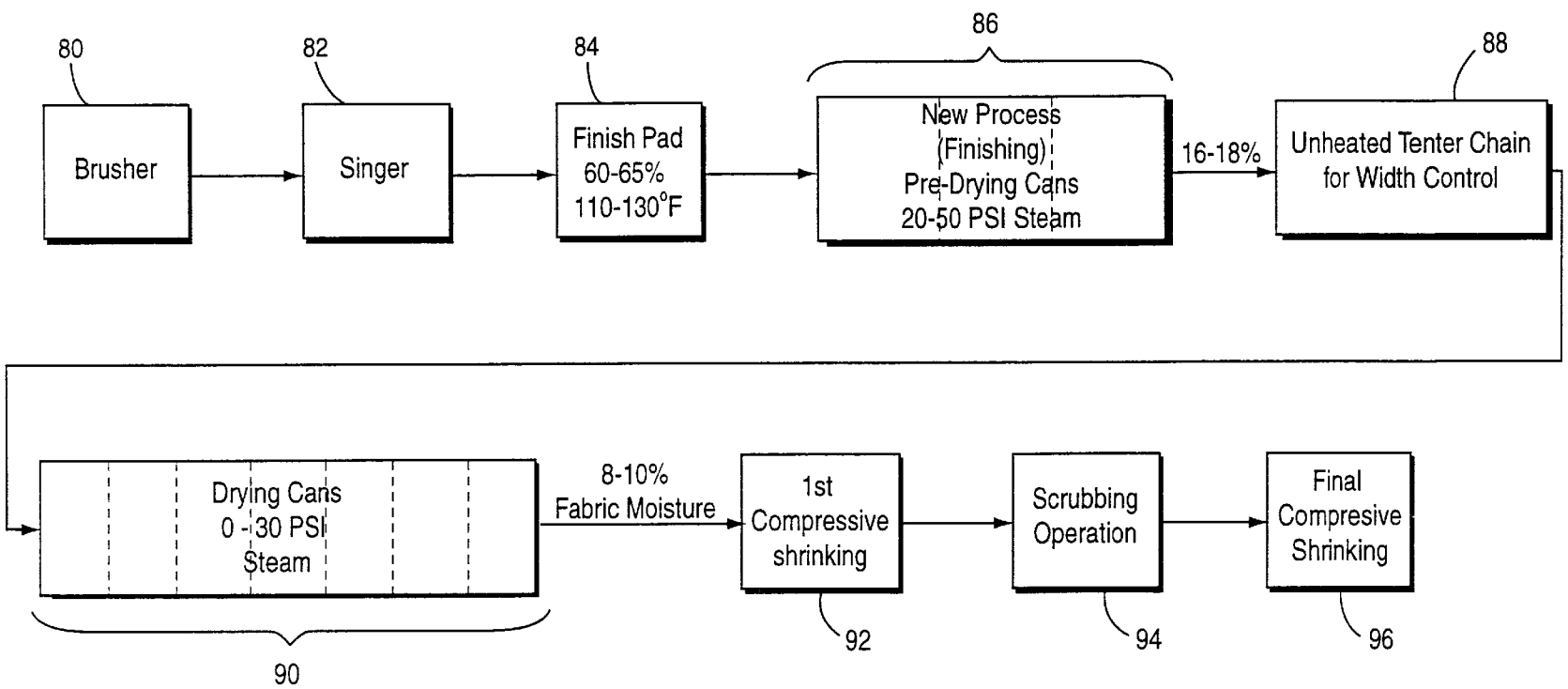
FIG. 2 is a schematic diagram of a finishing process for forming scrubbed stretch denim fabric according to the present invention.

After the yarns are dyed as set forth in the dyeing portion of FIG. 1 and after weaving, the new process passes the woven fabric formed of cellulose-based cotton blended with polyester warp yarns and polyester stretch fill yarns through a brusher and singer, as indicated at 80 and 82, respectively. The brushed fabric then passes through a finishing pad 84 at approximately 90 yards per minute. The finish applied by the finishing pad 84 is comprised of an aqueous solution of 116 pounds ITQ Softener HD 55, 16 pounds Sedgemul DNS-2, 5 pounds pigment N Blue 2 GC, i pound pigment Violet 4BC, 33 pounds Discol 2007 and 1 pound Defoamer with 2403 mixed in sufficient water to bring the total volume to 475 gallons. The finish pad box solution is applied to the fabric by passing the fabric over a series of immersed rolls, and subsequently passed through a squeeze roll to develop stretch. It is noted that the steps of preparation pad box scouring step 58, the open width washing of the fabric at 60 and drying the fabric at 62 as set forth in FIG. 1 and typifying the current process are eliminated. It has been found that the filling stretch can be developed without the open width wash boxes by applying the finish directly to the fabric with little tension in the warp direction, followed by pre-drying on a series of drying steam cans to about 16–18% moisture. In FIG. 2, the series of drying steam cans are indicated at 86 and are supplied with steam at 20–50 psi. Note that the new process minimizes tension and does not require the fabric to be relaxed, such as in a J-box, to help develop stretch. Moreover, the new process applies a finish comprised only of pigments, a fixer, surfactant and an anti-ozonate which constitutes the only wet application to the fabric.

Subsequent to pre-drying the fabric at 86, the width of the fabric with 16–18% moisture is set by a non-heated tenter chain indicated 88. The fabric is not passed into a drying oven at this stage as in the current process described above with respect to FIG. 1. From the unheated tenter chain for width control, the fabric is passed over a series of drying cans supplied with steam in a range of 0–30 psi. The steam cans 90 aid in the development of latent filling stretch. That is, the heat of drying produces steam on the fabric and, when the fabric is applied with little tension, the fabric will tend to develop filling stretch on its own, thus simplifying the finishing of the fabric at faster speeds, less expense and reduced potential for off-quality fabric goods. It will be appreciated that the elimination of the open width wash boxes and subsequent drying is contrary to industry standards for developing stretch as used in the current process.

Following the initial development of filling stretch and the drying, the fabric at 8–10% moisture is passed through a first compressive shrinking machine 92 which shrinks the fabric by approximately 8–10%. The fabric passes through the machine 92 at a speed of about 48–52 yards per minute. The fabric passing through machine 92 is run in tandem with a scrubbing operation having grit surfaces of 24–220, passing the fabric through the scrubber at approximately 48–52 ypm. Note that the process does not require a mechanical stretch pass on a compressive shrinking machine to further activate filling stretch and does not require a second scrubbing operation. It is believed that the second scrubbing operation as set forth in the patented process is unnecessary because the present fabric is passed directly from the finished pad box 84 to the drying cans 86, without the intervening step of washing the fabric in the open width wash boxes which further removes some of the starchy material left on the weave. With that material remaining on the weave as in the new process, it is believed that the scrubbing has less tendency to pull the fibers and will directly cut, rather than pull, the fibers, thus reducing the amount of pilling. Subsequent to the scrubbing operation 94, the fabric is passed through a final compressive shrinking operation 96 at about 45–50 yards per minute, affording shrinkage of 2–8% and a finished fabric width of 59–60 inches.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A process for finishing a stretchable woven denim fabric having cellulose containing warp yarns dyed with an indigo dye solution and stretch fill yarns, comprising the steps of:

(a) applying a finish including a pigment, a fixer, a surfactant and an anti-ozonate to the woven fabric;

(b) subsequent to step (a), pre-drying the fabric to about 16–18% moisture content;

(c) setting the width of the fabric by disposing the fabric on a tenter frame;

(d) subsequent to step (c), drying the fabric using steam cans;

(e) subsequent to step (d), passing the fabric through a compressive shrinking machine;

(f) scrubbing the fabric; and (g) immediately following step (a) and without any intermediate processing step, pre-drying the fabric according to step (b).

2. A process for finishing a stretchable woven denim fabric having cellulose containing warp yarns dyed with an indigo dye solution and stretch fill yarns, comprising the steps of:

(a) applying a finish including a pigment, a fixer, a surfactant and an anti-ozonate to the woven fabric;

(b) subsequent to step (a), pre-drying the fabric;

(c) setting the width of the fabric by disposing the fabric on a tenter frame;

(d) subsequent to step (c), drying the fabric using steam cans;

(e) subsequent to step (d), passing the fabric through a compressive shrinking machine;

(f) scrubbing the fabric; and (g) performing steps (a), (b), (c) and (d) while the fabric is passing a finish pad, pre-drying cans, the tenter frame and the steam drying cans of steps (a), (b), (c) and (d), respectively, at about 90 yards per minute.

3. A process for finishing a stretchable woven denim fabric having cellulose containing warp yarns dyed with an indigo dye solution and stretch fill yarns, comprising the steps of:

(b) applying a finish including a surfactant to the woven fabric;

(c) subsequent to step (a), pre-drying the fabric;

(d) establishing the width of the fabric;

(e) subsequent to step (c), drying the fabric so that the fabric shrinks;

(f) subsequent to step (d), passing the fabric through a compressive shrinking machine;

(g) immediately following step (a) and without any intermediate processing step, pre-drying the fabric according to step (b); and (h) immediately following step (a) and without any intermediate processing step, pre-drying the fabric according to step (b) to about 16–18% moisture content.

4. A process for finishing a stretchable woven denim fabric having cellulose containing warp yarns dyed with an indigo dye solution and stretch fill yarns, comprising the steps of:

(a) applying a finish including a surfactant to the woven fabric;

(b) subsequent to step (a), pre-drying the fabric;

(c) establishing the width of the fabric;

(d) subsequent to step (c), drying the fabric so that the fabric shrinks;

(e) subsequent to step (d), passing the fabric through a compressive shrinking machine;

(f) immediately following step (a) and without any intermediate processing step, pre-drying the fabric according to step (b); and (g) wherein step (d) includes drying the fabric to about 8–10% moisture content.

5. A process according to claim 4 wherein step (c) includes disposing the fabric on an unheated tenter frame.

6. A process according to claim 4 immediately following step (a) and without any intermediate processing step, pre-drying the fabric according to step (b), wherein step (c) includes disposing the fabric on an unheated tenter frame, and in accordance with step (d), drying the fabric using steam cans.

7. A process according to claim 4 including subsequent to step (e), scrubbing the fabric followed by the step of passing the fabric through a compressive shrinking machine.

8. A process for finishing a stretchable woven denim fabric having cellulose containing warp yarns dyed with an indigo dye solution and stretch fill yarns, comprising the steps of:

(a) applying a finish including a surfactant to the woven fabric;

(b) subsequent to step (a), pre-drying the fabric;

(c) establishing the width of the fabric;

(d) subsequent to step (c), drying the fabric so that the fabric shrinks;

(e) subsequent to step (d), passing the fabric through a compressive shrinking machine;

(f) immediately following step (a) and without any intermediate processing step, pre-drying the fabric according to step (b); and (g) wherein step (d) includes drying the fabric using steam cans, and performing steps (a), (b), (c) and (d) while the fabric is passing a finish pad, pre-drying cans, and the steam drying cans of steps (a), (b) and (d), respectively, at about 90 yards per minute.

9. A process for finishing a stretchable woven denim fabric having cellulose containing warp yarns dyed with an indigo dye solution and stretch fill yarns, comprising the steps of:

(a) applying a finish including a surfactant and at least one of a pigment, a fixer and an anti-ozonate to the woven fabric;

(b) subsequent to step (a), pre-drying the fabric;

(c) establishing the width of the fabric;

(d) subsequent to step (c), drying the fabric using steam cans;

(e) subsequent to step (d), passing the fabric through a compressive shrinking machine;

(f) scrubbing the fabric;

(g) performing the steps (b), (c) and (d) without substantially mechanically stretching the fabric; and (h) immediately following step (a) and without any intermediate processing step, pre-drying the fabric according to step (b) to about 16–18% moisture content.

10. A process according to claim 9 wherein step (c) is performed by disposing the fabric on a tenter frame.

11. An improved indigo dyeing and finishing process for forming a stretchable woven denim fabric comprising the steps of:

(a) passing warp yarns through an indigo dye bath maintained at a temperature in a range of about 70° to 90° F.;

(b) subsequent to step (a), washing and then drying the dyed warp yarns;

(c) forming the dyed warp yarns and stretch fill yarns into a woven denim fabric;

(d) subsequent to step (c), finishing the stretchable woven denim fabric by:

(d1) applying a finish including a surfactant to the woven fabric;

(d2) subsequent to step (d1), pre-drying the fabric;

(d3) establishing the width of the fabric;

(d4) subsequent to step (d3), drying the fabric enabling the fabric to shrink;

(d5) subsequent to step (d4), passing the fabric through a compressive shrinking machine; and (e) wherein the finishing of step (d1) is applied without previously passing the fabric through washboxes forming part of the finishing process of step (d).

12. A process according to claim 11 including, immediately following step (d1) and without any intermediate processing step, pre-drying the fabric according to step (d2).

13. A process according to claim 11, including, immediately following step (d1) and without any intermediate processing step, pre-drying the fabric according to the step (d2), wherein step (d3) includes disposing the fabric on an unheated tenter frame to set the fabric width, and in accordance with step (d4), drying the fabric using steam cans and, subsequent to step (d5), scrubbing the fabric and subsequently passing the scrubbed fabric through a compressive shrinking machine.

14. A process according to claim 11, wherein step (b) is performed by washing the dyed warp yarns at substantially ambient temperature.

15. An improved indigo dyeing and finishing process for forming a stretchable woven denim fabric comprising the steps of:

(a) passing warp yarns through an indigo dye bath maintained at a temperature in a range of about 70° to 90° F.;

(b) subsequent to step (a), washing and then drying the dyed warp yarns;

(c) forming the dyed warp yarns and stretch fill yarns into a woven denim fabric;

(d) subsequent to step (c), finishing the stretchable woven denim fabric by:

(d1) applying a finish including a surfactant to the woven fabric;

(d2) subsequent to step (d1), pre-drying the fabric;

(d3) establishing the width of the fabric;

(d4) subsequent to step (d3), drying the fabric enabling the fabric to shrink;

(d5) subsequent to step (d4), passing the fabric through a compressive shrinking machine; and (e) performing steps (d2) and (d3) without substantially mechanically stretching the fabric.

16. An improved indigo dyeing and finishing process for forming a stretchable woven denim fabric comprising the steps of:

(a) passing warp yarns through an indigo dye bath maintained at a temperature in a range of about 70° to 90° F.;

(b) subsequent to step (a), washing and then drying the dyed warp yarns;

(c) forming the dyed warp yarns and stretch fill yarns into a woven denim fabric;

(d) subsequent to step (c), finishing the stretchable woven denim fabric by:

(d1) applying a finish including a surfactant to the woven fabric;

(d2) subsequent to step (d1), pre-drying the fabric;

(d3) establishing the width of the fabric;

(d4) subsequent to step (d3), drying the fabric enabling the fabric to shrink;

(d5) subsequent to step (d4), passing the fabric through a compressive shrinking machine;

(e) immediately following step (d1) and without any intermediate processing step, pre-drying the fabric according to step (d2); and (f) step (d2) includes pre-drying the fabric to about 16–18% moisture content.

17. An improved indigo dyeing and finishing process for forming a stretchable woven denim fabric comprising the steps of:

(a) passing warp yarns through an indigo dye bath maintained at a temperature in a range of about 70° to 90° F.;

(b) subsequent to step (a), washing and then drying the dyed warp yarns;

(c) forming the dyed warp yarns and stretch fill yarns into a woven denim fabric;

(d) subsequent to step (c), finishing the stretchable woven denim fabric by:

(d1) applying a finish including a surfactant to the woven fabric;

(d2) subsequent to step (d1), pre-drying the fabric;

(d3) establishing the width of the fabric;

(d4) subsequent to step (d3), drying the fabric enabling the fabric to shrink;

(d5) subsequent to step (d4), passing the fabric through a compressive shrinking machine; and (e) performing steps (d1), (d2), (d3) and (d4) while the fabric is passing a finish pad, pre-drying cans, and the steam drying cans of steps (d1), (d2) and (d4), respectively, at about 90 yards per minute.

* * * * *